US009118148B2

(12) United States Patent
Pikielny

(10) Patent No.: US 9,118,148 B2
(45) Date of Patent: Aug. 25, 2015

(54) FLEXIBLE BATTERY CONNECTOR

(76) Inventor: Dov Pikielny, Herzliya (IL)

( * ) Notice: Subject to any disclaimer, the term of this patent is extended or adjusted under 35 U.S.C. 154(b) by 1341 days.

(21) Appl. No.: 12/633,866

(22) Filed: Dec. 9, 2009

(65) Prior Publication Data

US 2011/0136349 A1 Jun. 9, 2011

(51) Int. Cl.

| | |
|---|---|
| ***F21L 4/04*** | (2006.01) |
| ***H01R 13/631*** | (2006.01) |
| ***H01R 35/04*** | (2006.01) |

(52) U.S. Cl.

CPC ..... *H01R 13/6315* (2013.01); *H01R 35/04* (2013.01)

(58) Field of Classification Search

CPC ..... H01R 13/6315; H01R 35/04; A61M 2205/8206; A61N 1/375; H04N 2213/001; H04N 5/2252; A63B 43/002; G02B 7/32

USPC ..... 362/196–208, 194, 195, 157; 439/6, 439/8–11, 13, 52, 53, 500, 504

See application file for complete search history.

(56) References Cited

U.S. PATENT DOCUMENTS

| | | | | | |
|---|---|---|---|---|---|
| 1,986,281 | A * | 1/1935 | Nygard | 362/197 |
| 2,408,393 | A * | 10/1946 | Gits et al. | 200/60 |
| 4,495,550 | A * | 1/1985 | Visciano | 362/189 |
| 4,617,561 | A * | 10/1986 | Brown | 340/628 |
| 4,750,095 | A * | 6/1988 | Huang | 362/190 |
| 5,196,828 | A * | 3/1993 | Keniston | 340/568.7 |
| 5,211,471 | A * | 5/1993 | Rohrs | 362/206 |
| 5,521,803 | A * | 5/1996 | Eckert et al. | 362/198 |
| 5,716,121 | A * | 2/1998 | Dubois | 362/198 |
| 6,805,473 | B2 * | 10/2004 | Beard | 362/474 |
| 6,854,861 | B2 * | 2/2005 | Chao | 362/197 |
| 7,815,337 | B2 * | 10/2010 | Grossman | 362/189 |
| 8,556,450 | B2 * | 10/2013 | Grossman | 362/189 |
| 2008/0248378 | A1 * | 10/2008 | Mcguire | 429/99 |
| 2009/0129069 | A1 * | 5/2009 | Grossman | 362/189 |
| 2009/0251899 | A1 * | 10/2009 | Borchert | 362/287 |
| 2010/0330399 | A1 * | 12/2010 | Grossman | 429/7 |

* cited by examiner

*Primary Examiner* — Stephen F Husar
*Assistant Examiner* — Danielle Allen
(74) *Attorney, Agent, or Firm* — Dekel Patent Ltd.; David Klein

(57) ABSTRACT

A battery connector including an electrical connector including a plurality of terminals, each mechanically and electrically connectable with a battery, the terminals being in electrical communication with each other and mechanically connected to each other with a joint member that permits flexing the batteries with respect to one another.

12 Claims, 1 Drawing Sheet

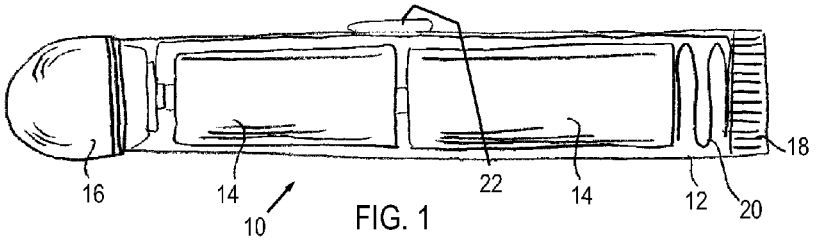
FIG. 1
PRIOR ART
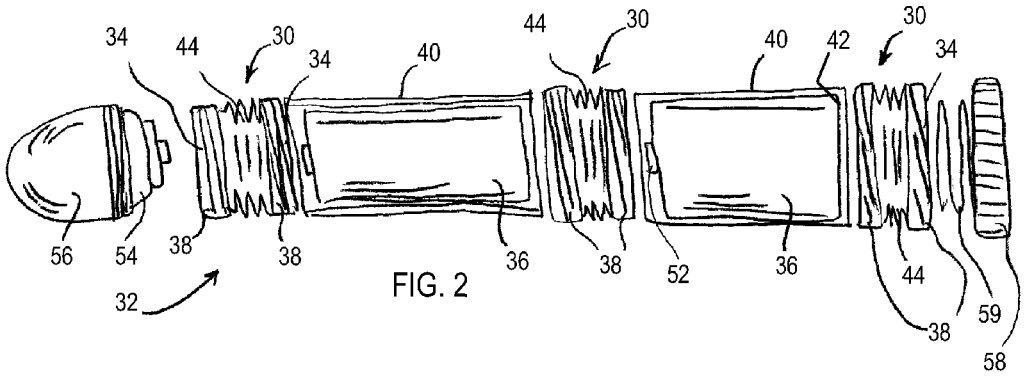
FIG. 2
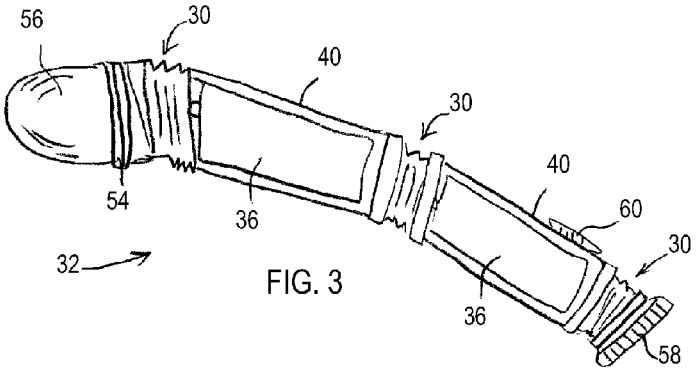
FIG. 3
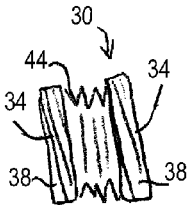
FIG. 4
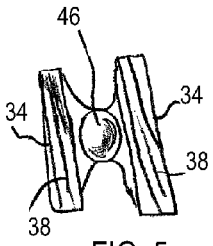
FIG. 5
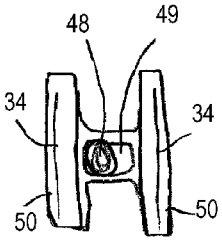
FIG. 6
FIG. 7
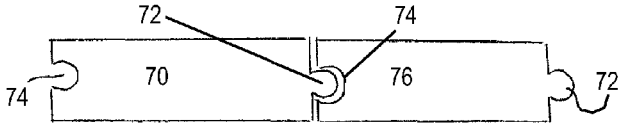

FLEXIBLE BATTERY CONNECTOR

FIELD OF THE INVENTION

The present invention relates generally to battery connectors for connecting batteries and particularly to a flexible battery connector, such as for flashlights and any other canisters for one or more batteries and the like.

BACKGROUND OF THE INVENTION

A typical prior art flashlight 10 is shown in FIG. 1. The flashlight 10 typically includes a rigid tubular battery housing 12, in which one or more batteries 14 are disposed. One of the batteries 14 electrically connects to a light bulb assembly 16 or any other consumer of the energy supplied from the battery, which may have screw threads for screwing on to housing 12. (It is noted that a flashlight is just one example. Other examples include the battery connecting to a small motor, toy and the like.) An end cap 18 may also have screw threads for screwing on to the opposite end of housing 12. End cap 18 may be in electrical communication with one of the batteries 14 by means of a spring 20 or other resilient connection designed to compensate for any tolerances. A switch 22 selectively closes the circuit between the batteries 14 and the light bulb assembly 16.

One of the drawbacks of such prior art such as flashlights is their rigidity. The more the batteries or the longer they are, the more inconvenient and bulky the appliance such as a flashlight becomes to carry on one's person or to store or to use.

Various attempts have been made in the past to make flexible flashlights. The prior art flexible flashlights typically include a rigid battery housing connected by some flexible connection to the light bulb assembly. However, such prior art flexible flashlights still comprise a rigid battery housing and therefore do not adequately solve the abovementioned problem.

SUMMARY OF THE INVENTION

The present invention seeks to provide a flexible battery connector, as is described more in detail hereinbelow. In accordance with an embodiment of the present invention, a plurality of batteries may be electrically and mechanically connected to one another with joint members that permit flexing adjoining batteries with respect to one another. This enables constructing flexible electrical assemblies, such as but not limited to, flexible flashlight assemblies, battery-operated toys and many others.

It is important to note that the present invention is a different concept and structure than flexible batteries (such as batteries made of paper) of the prior art. In prior art flexible batteries, the battery itself is flexible. In contrast, in the present invention, the battery is rigid and remains rigid; the joint members permit flexing adjoining rigid batteries with respect to one another.

There is provided in accordance with an embodiment of the present invention a battery connector including an electrical connector including a plurality of terminals, each mechanically and electrically connectable with a battery, the terminals being in electrical communication with each other and mechanically connected to each other with a joint member that permits flexing the batteries with respect to one another.

In accordance with an embodiment of the present invention each of the terminals may include a screw-thread connection for threaded connection with a battery housing that has a complimentary screw-thread connection, the battery housing being adapted for housing therein a battery. Alternatively, each of the terminals may include a snap-on connection for securing to a battery terminal.

The joint member may include, without limitation, a bellows, a ball-and-socket connection, and/or a rotary joint member adapted for rotation about a rotation axis, the rotary joint member being arranged for translational movement in a channel, or by constructing the batteries with matching curved faces, such as matching concave and convex faces that articulate with each other.

A plurality of batteries may be connected to adjacent terminals so that the batteries are flexible with respect to one another. A flashlight component may be connected to one of the terminals, e.g., a flashlight cap with a light. A switch may be in selective electrical communication with the battery and the light. An end cap may be mechanically and electrically connected to one of the batteries with a joint member that permits flexing that battery with respect to the end cap, the end cap being in electrical connection with the flashlight cap through the switch.

BRIEF DESCRIPTION OF THE DRAWINGS

The present invention will be understood and appreciated more fully from the following detailed description taken in conjunction with the drawings in which:

FIG. 1 is a simplified illustration of a prior art flashlight with rigid battery connections;

FIGS. 2 and 3 are simplified exploded and pictorial illustrations, respectively, of battery connectors used in the construction of a flexible flashlight, constructed and operative in accordance with an embodiment of the present invention;

FIGS. 4, 5 and 6 are simplified pictorial illustrations of different embodiments of battery connectors of the present invention; and FIG. 7 is simplified illustration of a first battery with a male joint electrical terminal which mates and articulates with a corresponding female joint electrical terminal of a second battery.

DETAILED DESCRIPTION OF EMBODIMENTS

Reference is now made to FIGS. 2 and 3, which illustrate a plurality of battery connectors 10, constructed and operative in accordance with an embodiment of the present invention. In the illustrations, the battery connectors 30 are used in the construction of a flexible flashlight 32, but it is understood that the invention is not limited to flashlights and the battery connectors 30 may be used in many other applications, such as but not limited to, toys, radios, camera equipment, personal communication devices, medical devices, mechanical devices and many others. The battery connectors 30 open up the possibility of constructing an almost infinite number of flexible electromechanical assemblies.

Each battery connector 30 is an electrical connector that includes a plurality of terminals 34, each mechanically and electrically connectable with a battery 36. For example, terminal 34 may be constructed of a conductive (e.g., metal) strip, disk, contact and the like in electrical contact with a screw-thread connection 38 for threaded connection with a battery housing 40 that has a complimentary screw-thread connection 42. The battery housing 40 is adapted for housing the battery 36 (e.g., size AA, A, D or any size and configuration of battery).

The terminals 34 are in electrical communication with each other and mechanically connected to each other with a joint member 44 that permits flexing the batteries 36 with respect to one another. For example, as seen in FIG. 4, the joint member 44 may be a bellows, which permits the batteries 36 to translate with respect to each other in three mutually orthogonal directions and to rotate, flex or articulate (all of these terms being used interchangeably) about at least two of the three mutually orthogonal axes, and to rotate a certain amount in torsion as well. The bellows may be constructed of an electrically conductive material (e.g., metal or metal-impregnated fibers) which effects the electrical connection between terminals 34. Additionally or alternatively, there may be a flexible wire connecting the terminals 34 inside the bellows, in which case the bellows need not be constructed of an electrically conductive material.

The invention is not limited to this type of construction. For example, as seen in FIG. 5, the joint member may include a ball-and-socket connection 46. Here again, the ball-and-socket connection 46 may be constructed of an electrically conductive material (e.g., metal) which effects the electrical connection between terminals 34. Additionally or alternatively, there may be a flexible wire connecting the terminals 34, in which case the ball-and-socket connection 46 need not be constructed of an electrically conductive material.

As another example, as seen in FIG. 6, the joint member may include a rotary joint member 48 adapted for rotation about a rotation axis (in this case, running perpendicular into the drawing sheet). The rotary joint member 48 may be arranged for translational movement in a channel 49.

FIG. 6 also illustrates that terminal 34 need not be a screw-thread connection 38, rather, without limitation, terminal 34 may include a snap-on connection 50 for securing to a battery terminal 52 (the terminal 52 being shown in FIG. 2).

Referring again to FIGS. 2 and 3, one or more of the terminals 34 of the battery connectors 30 may be electrically connected to an electrical component, such as by a screw-thread connection. For example, one of the terminals 34 of one of the battery connectors 30 may be electrically connected to a flashlight component, such as a flashlight cap 54 with a light 56. An end cap 58 (and spring 59) (FIG. 2) may be mechanically and electrically connected to one of the batteries 36 via one of the battery connectors 30 that permits flexing that battery 36 with respect to the end cap 58. The end cap 58 may be in electrical connection with the flashlight cap 54 and light 56 through a switch 60 (shown in FIG. 3).

Yet another example is shown in FIG. 7. In this example, a first battery 70 includes a male joint electrical terminal 72 which mates and articulates with a corresponding female joint electrical terminal 74 of a second (adjoining) battery 76. The male joint electrical terminal 72 may be a convex shaped terminal (e.g., spherical shape) and the female joint electrical terminal 74 may be a concave shaped terminal (e.g., bowl shape). The two batteries are thus joined and articulate with each other in the manner of a ball-and-socket connection, like a femoral head articulates with an acetabulum in a hip joint.

Thus, in accordance with an embodiment of the present invention, a plurality of batteries 36 may be electrically and mechanically connected to one another with joint members that permit flexing adjoining batteries with respect to one another. This enables constructing flexible electrical assemblies, such as but not limited to, flexible flashlight assemblies.

It will be appreciated by persons skilled in the art that the present invention is not limited by what has been particularly shown and described hereinabove. Rather the scope of the present invention includes both combinations and subcombinations of the features described hereinabove as well as modifications and variations thereof which would occur to a person of skill in the art upon reading the foregoing description and which are not in the prior art.

What is claimed is:

1. A battery connector comprising:

a pair of batteries, each having a negative pole and a positive pole; and an electrical connector comprising a plurality of terminals, each mechanically and electrically connectable with said batteries, said terminals being in electrical communication with each other and mechanically connected to each other with a joint member that permits flexing said batteries with respect to one another, wherein said joint member comprises a bellows located between said terminals, and wherein said bellows and said terminals are located between the negative pole of one of said batteries and the positive pole of the other of said batteries so that said batteries are flexible with respect to one another.

2. The battery connector according to claim 1, wherein at least one of said terminals comprises a screw-thread connection for threaded connection with a battery housing that has a complimentary screw-thread connection, said battery housing being adapted for housing therein a battery.

3. The battery connector according to claim 1, wherein at least one of said terminals comprises a snap-on connection for securing to a battery terminal.

4. The battery connector according to claim 1, wherein at least one of said terminals comprises a screw-thread connection for threaded connection with an electrical component that has a complimentary screw-thread connection.

5. The battery connector according to claim 1, wherein said joint member comprises a ball-and-socket connection.

6. The battery connector according to claim 1, wherein said joint member comprises a rotary joint member adapted for rotation about a rotation axis, said rotary joint member being arranged for translational movement in a channel.

7. The battery connector according to claim 1, wherein said joint member comprises a male joint electrical terminal of a first battery which mates and articulates with a corresponding female joint electrical terminal of a second battery.

8. The battery connector according to claim 7, wherein said male joint electrical terminal comprises a convex shaped terminal and said female joint electrical terminal comprises a concave shaped terminal.

9. A battery connector comprising:

a pair of batteries, each having a negative pole and a positive pole;

an electrical connector comprising a plurality of terminals, each mechanically and electrically connectable with said batteries, said terminals being in electrical communication with each other and mechanically connected to each other with a joint member that permits flexing said batteries with respect to one another, and further comprising a flashlight component connected to one of said batteries, and wherein said joint member and said terminals are located between the negative pole of one of said batteries and the positive pole of the other of said batteries so that said batteries are flexible with respect to one another.

10. The battery connector according to claim 9, wherein said flashlight component comprises a flashlight cap with a light.

11. The battery connector according to claim 10, further comprising a switch in selective electrical communication with at least one of said batteries and said light.

12. The battery connector according to claim 10, further comprising an end cap mechanically and electrically connected to one of said batteries with a joint member that permits flexing that battery with respect to the end cap, said end cap being in electrical connection with the flashlight cap through said switch.

* * * * *